United States Patent [19]

Dolan

[11] 4,142,965

[45] Mar. 6, 1979

[54] SLUICE BOX

[76] Inventor: Adelbert H. Dolan, 1535 S.E. Lafayette, Albany, Oreg. 97321

[21] Appl. No.: 896,214

[22] Filed: Apr. 13, 1978

Related U.S. Application Data

[63] Continuation of Ser. No. 733,955, Oct. 19, 1976, abandoned.

[51] Int. Cl.[2] ..... B07B 11/08

[52] U.S. Cl. ..... 209/487; 209/506; 210/433 R

[58] Field of Search ..... 209/18, 156, 157, 483–487, 209/506, 507, 458; 210/433 R

[56] References Cited

U.S. PATENT DOCUMENTS

| | | | |
|---|---|---|---|
| 629,466 | 7/1899 | Quackenbush | 209/485 X |
| 1,352,882 | 9/1920 | Donegan | 209/18 |
| 1,670,206 | 5/1928 | Morgan | 209/458 X |

FOREIGN PATENT DOCUMENTS

| | | | |
|---|---|---|---|
| 787090 | 9/1935 | France | 209/506 |

*Primary Examiner*—Frank A. Spear, Jr.
*Assistant Examiner*—Richard W. Burks
*Attorney, Agent, or Firm*—Eugene M. Eckelman

[57] ABSTRACT

A chute is formed by a bottom wall and side walls, and the bottom wall is provided with cross grooves for catching ore particles. The bottom and front walls of the grooves are formed on about the same radius of curvature with the curvature of the front wall forming an undercut under the feed edge of the grooves. The rear wall of the grooves leads from the bottom wall in a straight line inclined upwardly in a discharge end direction. Ore containing material which is fed down the chute is separated out in the grooves by a back eddy developed by the particular shape of the grooves.

1 Claim, 3 Drawing Figures

SLUICE BOX

This is a continuation, of application Ser. No. 733,955, filed Oct. 19, 1976 now abandoned.

BACKGROUND OF THE INVENTION

This invention relates to new and useful improvements in sluice boxes.

SUMMARY OF THE INVENTION

According to the present invention and forming a primary objective thereof, a sluice box is provided that is extremely simplified in construction and thus inexpensive to manufacture and at the same time employs means for efficiently separating out ore particles from ore containing material fed thereto.

The invention is carried out by a sluice box construction employing a bottom wall and side walls which form a chute-like structure. The bottom wall has a plurality of cross grooves therein which have a novel shape in that they employ an undercut portion which causes eddy currents at the grooves during the flow of the ore containing materials down the chute.

The invention will be better understood and additional objects and advantages will become apparent from the following description taken in connection with the accompanying drawings which illustrate a preferred form of the device.

DETAILED DESCRIPTION OF A PREFERRED EMBODIMENT

Figure 2:
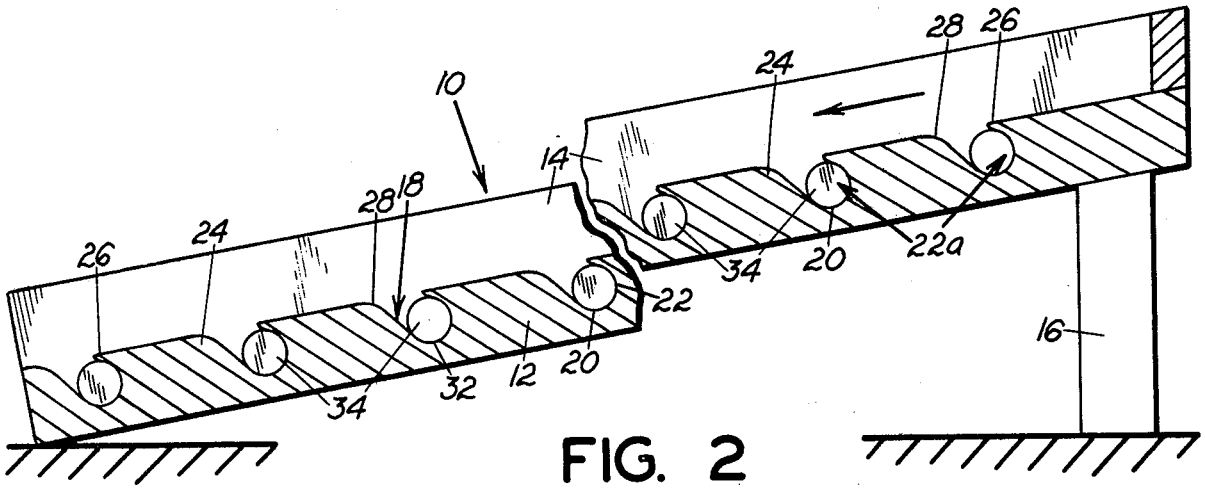
FIG. 2 is an elongated, foreshortened longitudinal sectional view of the sluice box, taken on the line 2—2 of FIG. 1.
Figure 1:
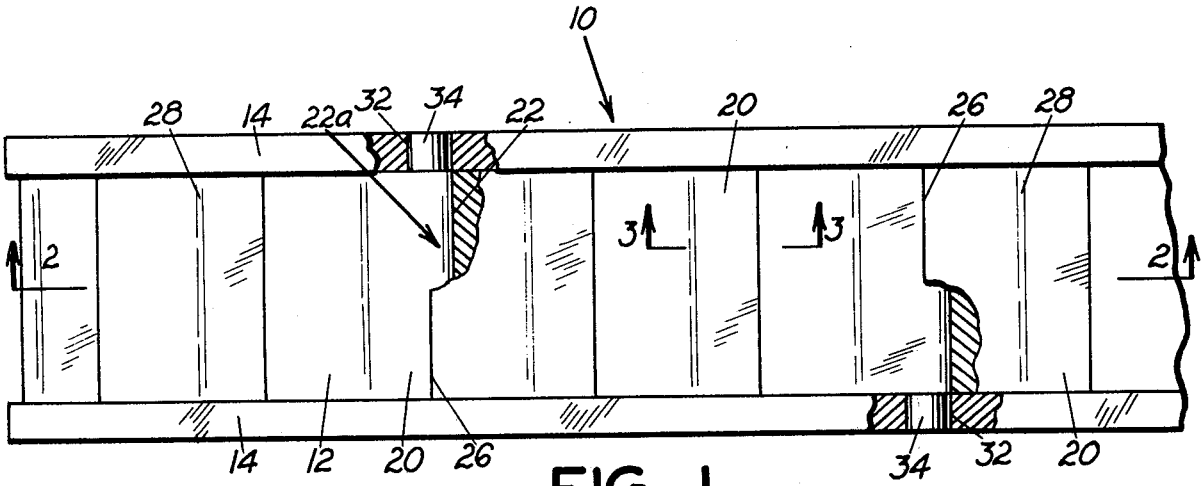
FIG. 1 is a top plan view of a sluice box embodying principles of the present invention.

With particular reference to FIGS. 1 and 2, the present sluice box is indicated generally by the numeral 10 and includes primarily a full length bottom wall 12 and full length side walls 14. With the sluice box elevated at one end, such as by an end foot 16, a chute is formed between the bottom and side walls. The amount of incline of the sluice box may vary according to the flow desired or according to the material being treated. A two inch fall per foot in length of sluice box is representative.

Figure 3:
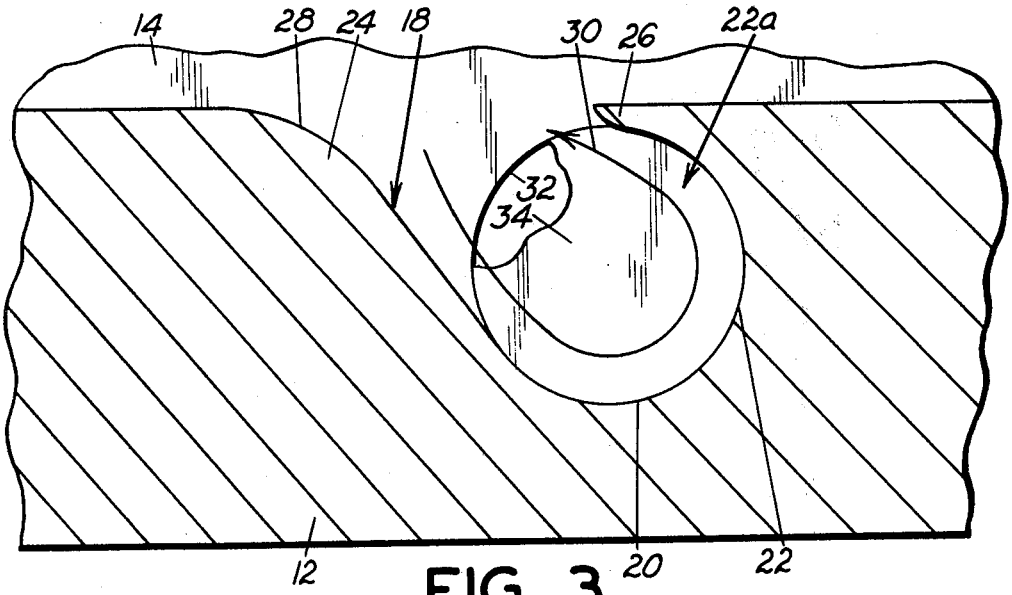
FIG. 3 is an enlarged fragmentary sectional view taken similar to FIG. 2 but showing in detail the cross sectional configuration of the ore catching grooves.

The upper surface of the bottom wall 12 is provided with a plurality of cross grooves 18 the cross sectional shape of which is best illustrated in detail in FIG. 3. More particularly, each of the grooves has a rounded bottom wall portion 20, a rounded front wall portion 22, and a rear wall portion 24. The front and rear defining edges of the grooves are identified by numerals 26 and 28, respectively, the edge 26 comprising the front or feed edge and the edge 28 comprising the rear or discharge edge.

The bottom wall portion 20 and the front wall portion 22 of the grooves are generally rounded as stated and these two portions are formed substantially on the same radius of curvature such as occur when the cross grooves are formed by drilling. The curved front wall portion 22 forms an undercut 22*a* back of front edge 26. Rear wall portion 24 extends from the rearward end of bottom wall 20 to the edge 28 in substantially a straight line, the edge 28 being disposed rearwardly of its juncture with bottom wall 20 whereby wall portion 24 thus is inclined rearwardly. This rear wall portion preferably extends at about a 45 degree angle relative to the top surface of the bottom wall 12. Edge 28 is rounded from front to rear in a gentle curvature. The edge 26 is substantially sharp or unrounded.

As the ore containing material, preferably in a solution of water, flows down the chute, the heavier the material falls by gravity into the grooves. In such movement, the material first impinges against wall 24 and then is reversed to move in a forward direction. The solution swirls through the undercut portion 22*a* as shown by arrow 30, and in the eddy current established by this flow, a good separation of ore particles results. Such particles settle to the bottom of the grooves and the lighter material is discharged into the fluid and flows down the chute. Any ore particles that do not settle out in the first grooves will be picked up in following grooves.

To obtain best results from the grooves, the diameter of the rounded portion thereof at wall portions 20 and 22 is approximately the same as the longitudinal length of the opening between the edges 26 and 28. Such provides the desired access of solution to the grooves in proportion to the working ability of the eddy current therein for best separation.

One of the side walls 14 and both if desired, have apertures 32 the bottom portion of which is aligned with the bottom wall 20 of the grooves. These apertures are normally closed by plugs 34 which can be removed when it is desired to clean ore particles from the grooves. To remove ore particles from the grooves, the plugs 34 are taken out and such particles merely swept or washed out through the side apertures.

In accordance with the invention, I have perfected a design that is extremely effective in ore separation and is easy to operate. In addition, it is simple and basic in design.

It is to be understood that the form of my invention herein shown and described is to be taken as a preferred example of the same and that various changes in the shape, size and arrangement of parts may be resorted to without departing from the spirit of my invention or the scope of the subjoined claims.

Having thus described my invention, I claim:

1. A sluice box comprising (a) a bottom wall having an upper surface and opposite ends comprising a feed end and a discharge end, (b) upright side walls on said bottom wall forming a chute with said bottom wall down which ore containing solution fed into said feed end may flow upon inclined support of the sluice box, (c) means defining a plurality of cross grooves in said bottom wall each having a pointed feed edge and a rounded discharge edge downstream from the feed edge, (d) each of said grooves having a bottom wall portion, a front wall portion leading from said bottom wall portion to said feed edge, and a rear wall portion leading from said bottom wall portion to said discharge edge, (e) said bottom wall portion and said front wall portion being formed on substantially the same circular radius of curvature and the front wall portion forming an undercut under the feed edge, (f) said rear wall portion being inclined downwardly and forwardly in a straight line and leading from said rounded discharge edge into a continuous uninterrupted plane with said curved bottom portion, (g) the diameter of said grooves at said bottom and front wall portions being approximately equal to the distance between said feed edge and said discharge edge, (h) and cleanout means extending through one of said side walls at said grooves for removing particles deposited in said grooves.

* * * * *